US005664473A

United States Patent [19]

Huang

[11] Patent Number: 5,664,473

[45] Date of Patent: Sep. 9, 1997

[54] PUNCH

[76] Inventor: Jackson Huang, No. 162-1, Sanchiao Rd., Pingho Tsun, Tatsun Hsiang, Changhua Hsien, Taiwan

[21] Appl. No.: 556,373

[22] Filed: Nov. 13, 1995

[51] Int. Cl.[6] ..... B26D 5/10; B27F 1/02

[52] U.S. Cl. ..... 83/620; 83/464; 83/167

[58] Field of Search ..... 83/618, 619, 620, 83/629, 633, 453, 454, 464, 560, 167

[56] References Cited

U.S. PATENT DOCUMENTS

| | | | |
|---|---|---|---|
| 2,481,883 | 9/1949 | Semler | 83/560 |
| 2,482,218 | 9/1949 | Segal | 83/560 X |
| 3,826,168 | 7/1974 | Groswith, III et al. | 83/629 X |
| 4,499,805 | 2/1985 | Mori | 83/618 X |
| 5,040,441 | 8/1991 | Tamura | 83/620 X |

*Primary Examiner*—Rinaldi I. Rada
*Assistant Examiner*—Elizabeth Stanley
*Attorney, Agent, or Firm*—Gunn, Lee & Miller, P.C.

[57] ABSTRACT

A punch includes a base portion on which at least two punching units are disposed. The punching units are connected by a shaft extending therethrough. Each one of the punching units has an actuating device securely disposed to the shaft. The actuating device has at least one toothed element, a box portion disposed to each one of the punching unites and a block disposed in the box portion. The block provides a passage defined longitudinally therethrough and a punching rod disposed to an underside thereof and received in the passage. The block has at least on rack disposed thereto so as to engage to the toothed element such that when the shaft connected to a handle is pivoted, the block is moved downwardly, and each one of the punching devices slidably moves along the shaft so as to adjust a distance between two punching units.

4 Claims, 6 Drawing Sheets

PUNCH

BACKGROUND OF THE INVENTION

The present invention relates to a punch and, more particularly, to a punch in which a distance between two punching rods is adjustable.

A punch is designed for punching holes in one or more sheets of papers or documents so as to allow retention of the papers by ring binders. Generally, the paper punch as at least two cylindrical punching rods disposed between a handle portion and a base portion, each one of the two punching rods is moved vertically when pushing the handle portion down such that papers can be punched to have two holes therein. Broader papers, such as size B4, need holes with a larger distance therebetween and papers of a size such as A4 need a shorter distance between two holes. The conventional punch can not provide a feature of varying the distance between the punching rods.

The present invention provides a punch in which a distance between two punching rods can be varied when needed so as to mitigate or obviate the above-mentioned problems.

SUMMARY OF THE INVENTION

The present invention provides a punch which includes a base portion on which at least two punching units are disposed. The punching units are connected by a shaft extending therethrough such that the punching units can be moved along the shaft to adjust a distance between the two punching units. Each one of the punching units has an actuating means securely disposed to the shaft and the actuating means has at least one toothed element. A box portion is disposed to each one of the punching units and a block is disposed in the box portion. The block has a passage defined longitudinally therethrough and a punching rod is disposed to an underside thereof and is received in the passage. The block has at least one rack disposed thereto so as to engage with the toothed element such that when the shaft connected to a handle is pivoted, the block is moved downwardly.

It is an object of the present invention to provide a punch having a feature of being able to adjust a distance between two punching rods.

Other objects, advantages, and novel features of the invention will become more apparent from the following detailed description when taken in conjunction with the accompanying drawings

DETAILED DESCRIPTION OF THE PREFERRED EMBODIMENT

Figure 1:
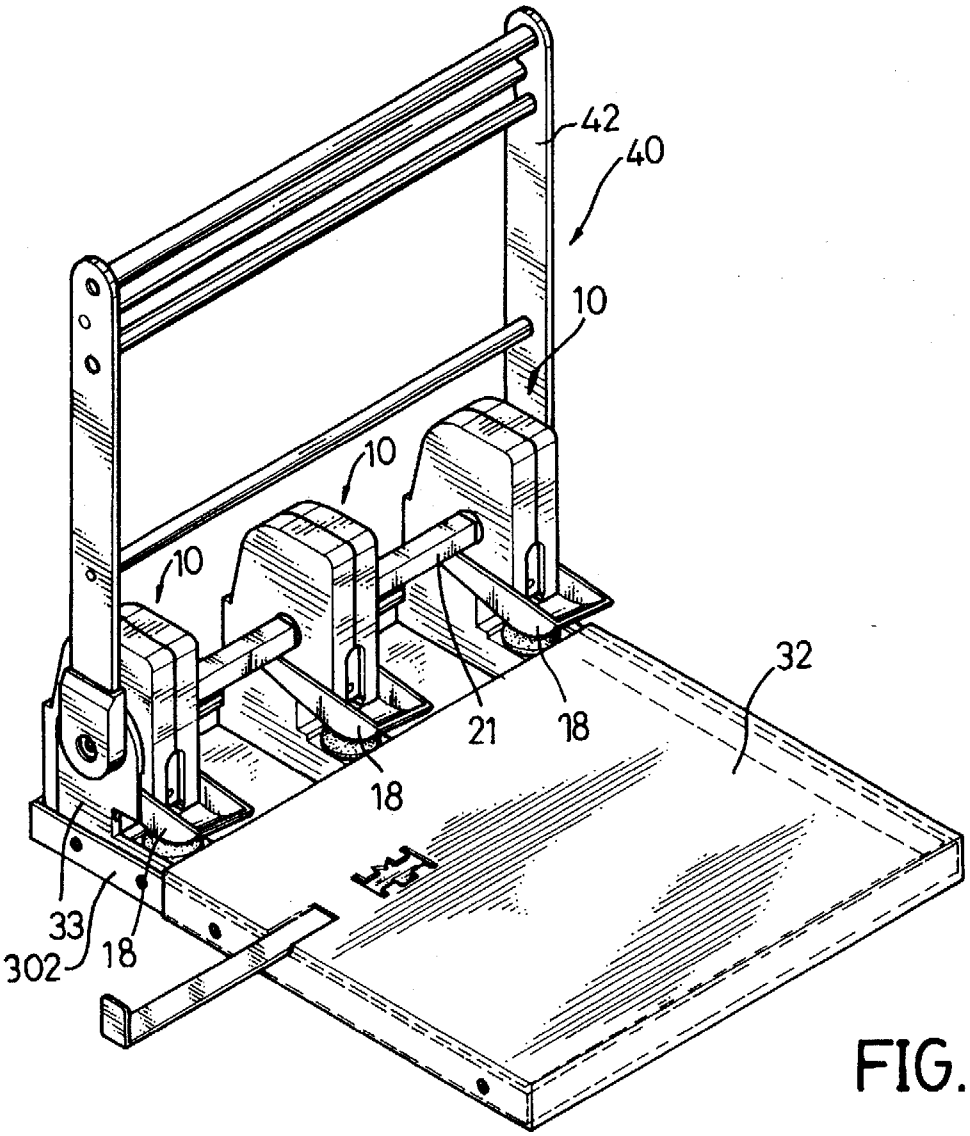
FIG. 1 is a perspective view of a punch in accordance with the present invention.
Figure 2:
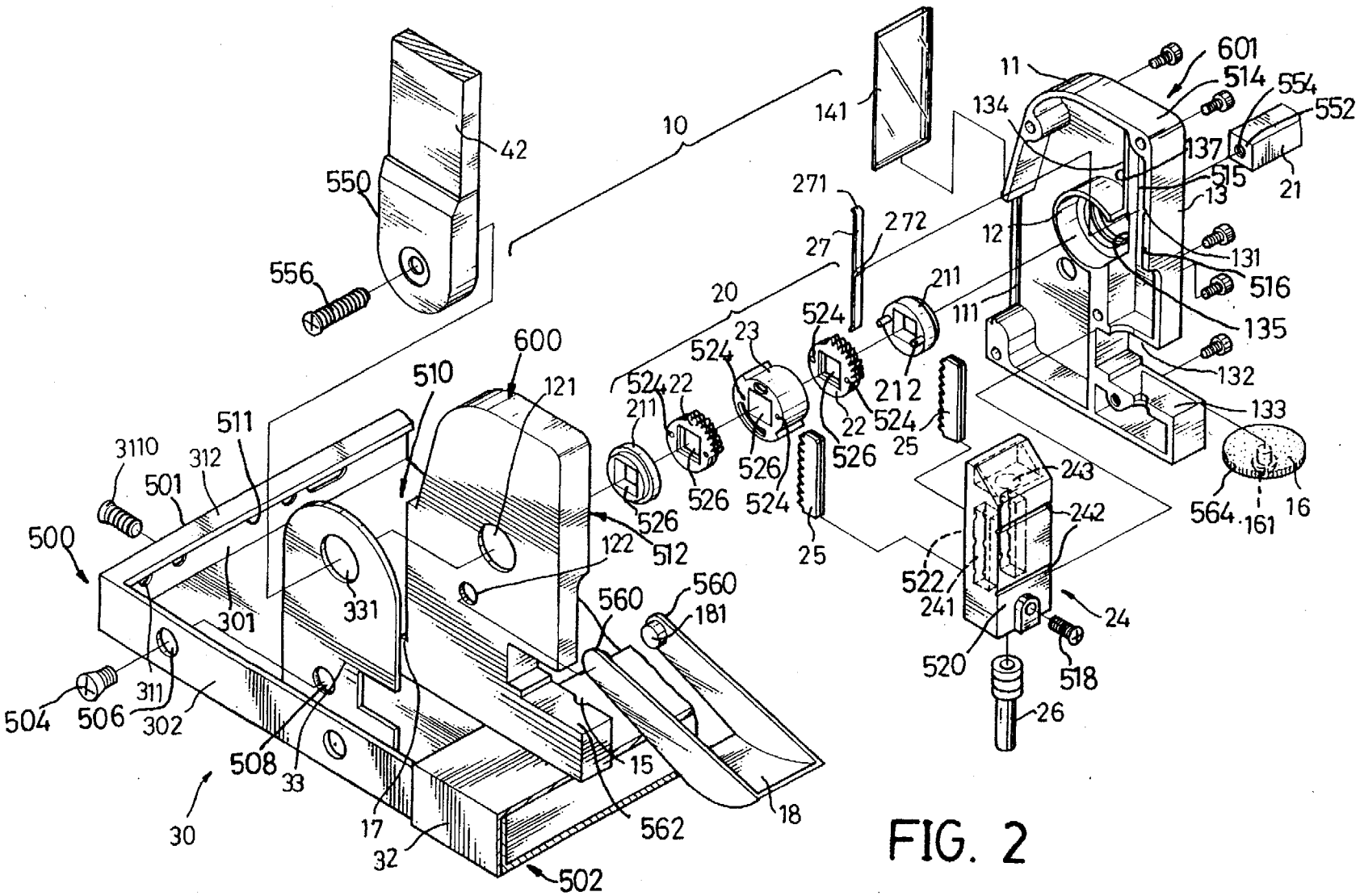
FIG. 2 is an exploded view of a punching unit in accordance with the present invention.
Figure 3:
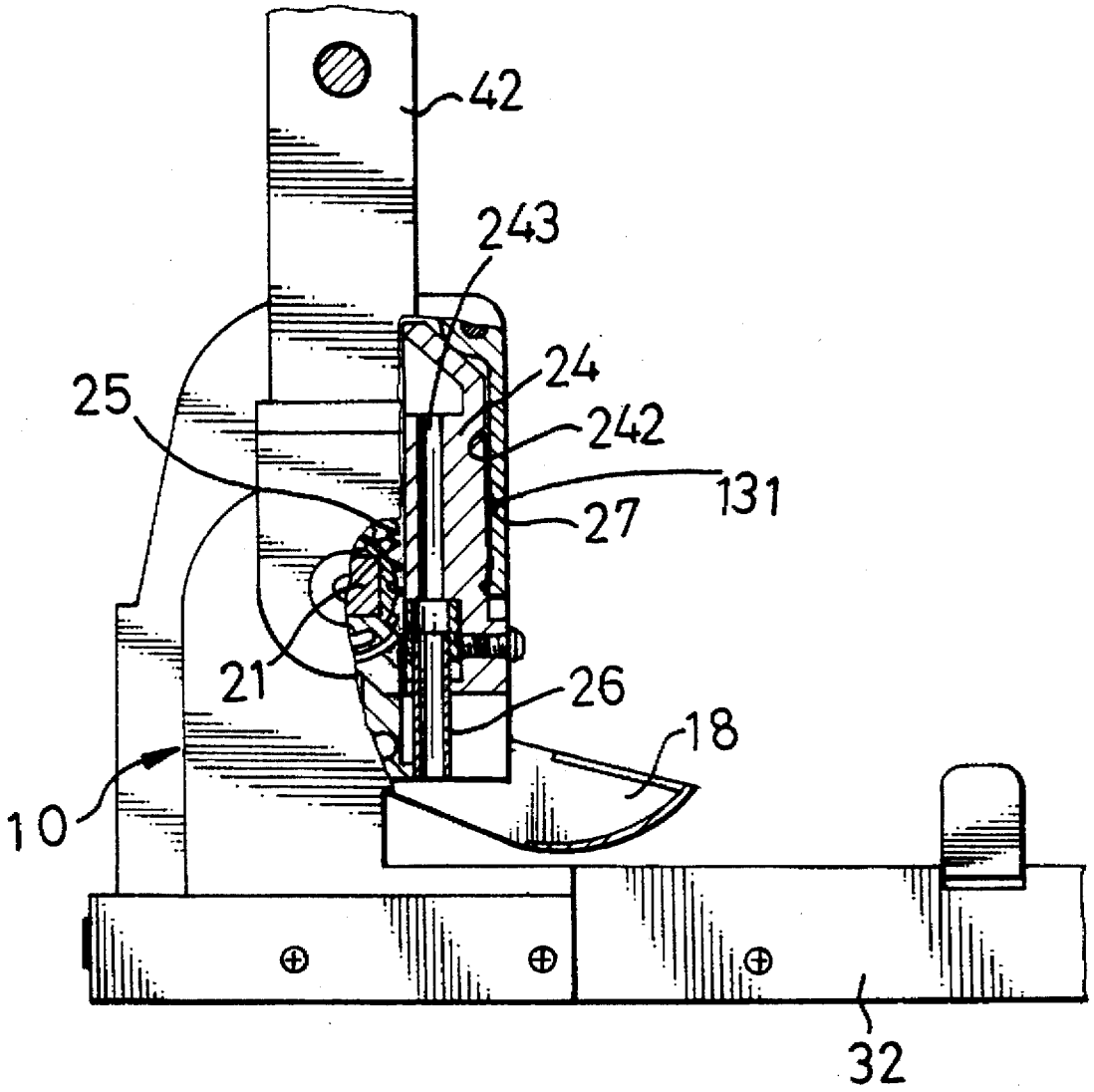
FIG. 3 is a side elevational view, partly in section, of the punch in accordance with the present invention.

Referring to the drawings and initially to FIGS. 1 through 3, a punch in accordance with the present invention generally includes a base portion 30 being a rectangular plate and having a first end 500 and a second end 502, the first end 500 thereof having a first wall 301 extending upwardly therefrom in which a plurality of first holes 311 are defined. A first flange 312 extends along a top edge 501 of the first wall 301 toward the second end 502 of the base portion 30. Side walls 302 extend upwardly from each one of two sides of the base portion 30. A lug 33 fixedly extends upwardly from each one of the side walls 302 by bolts 504 extending through a hole 506 defined in the side wall 302 and a hole 508 defined in the lug 33. Each one of the lugs 33 has a hole 331 defined therein.

Three punching units 10 are disposed to the first end 500 of the base portion 30. Each one of the punching units 10 includes a casing 11 which is composed of two halves 600 and 601 and the casing 11 has a first end 510 and a second end 512, the first end of the casing 11 having a shoulder portion 17 extending toward the first end 510 of the casing 11 so as to engage an underside 511 of the first flange 312. The casing 11 is engaged to the first wall 301 of the base portion 30 by extending a bolt 3110 through the first hole 311 of the first wall 301 and being fixedly engaged to the first end 510 of the casing 11. Each one of the two halves 600 and 601 of the casing 11 has a central hole 121 defined therein and a second hole 122 is defined below the central hole 121. A tubular element 12 extends transversely from an inner side of each one of the two halves of the casing 11 and communicates with the central hole 121. An opening 111 is defined in the first end 510 of the casing 11 and is covered by a transparent board 141 wherein the two sides defining the opening 111 each have a slot 1110 (FIG. 5) defined longitudinally therein such that the transparent board 141 is inserted in the slots 1110 to close the opening 111. The second end 512 of the casing 11 has a box portion 13 and a support portion 133. The box portion 13 has a closed top 514 and an open bottom 132 and a partition 134 disposed opposite an inner side 516 of the box portion 13 to define a space 515 in the box portion 13. The partition 134 has a first open portion 135 and a second open portion 137. The inner side 516 of the partition 134 has a notch 131 for receiving protrusion 272 as discussed below. The support portion 133 is located below the casing 11 and spaced apart from the open bottom 132 of the box portion 13.

A block 24 is disposed in the space 515 within the box portion 13 and has a longitudinally extending passage 243 for receiving a punching rod 26 in the passage 243. The punching rod 26 is fixed in the passage 243 by threadedly engaging a bolt 518 through the block 24 and urging against the punching rod 26. The rod 26 extends from the open bottom 132 of the box portion 13. The block 24 has a front surface 520 with two transverse grooves 242 and a rear surface 522 facing the partition 134 having two longitudinal recesses 241 to receive racks 25. An elongated plate 27 is provided with two hook ends 271 for engagement with the corresponding groove 242 of the block 24. The elongated plate 27 has a middle protrusion 272 for engagement with the notch 131 to position the block 24 corresponding in the box portion 13.

An actuating means 20 is disposed in the casing 11 and is received in the tubular element 12. The actuating means 20 includes a central element 23, two toothed elements 22 and two outer elements 211. Each one of the two toothed elements 22 is disposed to a respective one of two sides of the central element 23 while the outer elements 211 are disposed to an outer side of the toothed element 22. Each one of the outer elements 211 has two outwardly extending studs 212 and each of the toothed elements 22 and the central element 23 have two stud receiving holes 524. These five elements (two outer elements 211, two toothed elements 22, and central elements 23) can be connected together by extending the studs 212 through the receiving holes 524 of the toothed elements 22 and the central element 23. Each one of the outer elements 211 and the toothed elements 22 and the central element 23 have a central rectangular hole 526 defined to receive a rectangular cross-section shaft 21. The actuating means 20 is rotated with the shaft 21. The two toothed elements 22 engage the racks 25 through an open portion 135 in partition 134 so that when the shaft 21 is rotated, the block 24 and the punching rod 26 move upwardly or downwardly.

A handle 40 which includes two arms 42 is secured to the shaft 21. One of the arms 42 is securely attached to a first end 552 of the shaft 21 which extends through the corresponding lug 33. The shaft 21 has a threaded recess 554 defined in its first end 552 for receiving a bolt 556 extending through the arm 42. The other arm 42 of the handle 40 is likewise securely attached to the other end of the shaft 21 extending from another lug 33.

Each one of the punching units 10 has a pivotal pressing element 18. The pressing element 18 is a U-shaped element having two distal ends 560. Each distal end 560 has a boss 181 for pivotal engagement with the hole 122 in a respective one of two halves 600 and 601 of the corresponding casing 11. The pressing element presses against paper 50 inserted between the box portion 13 and the support portion 133. The support portions 133 each have a semi-circular hole 15 in an upper surface 562 for receiving a receiving piece 16. The receiving piece 16 has a protrusion 161 extending from an underside 564 for fitting into the holes 15 of the support portions 133.

Figure 4:
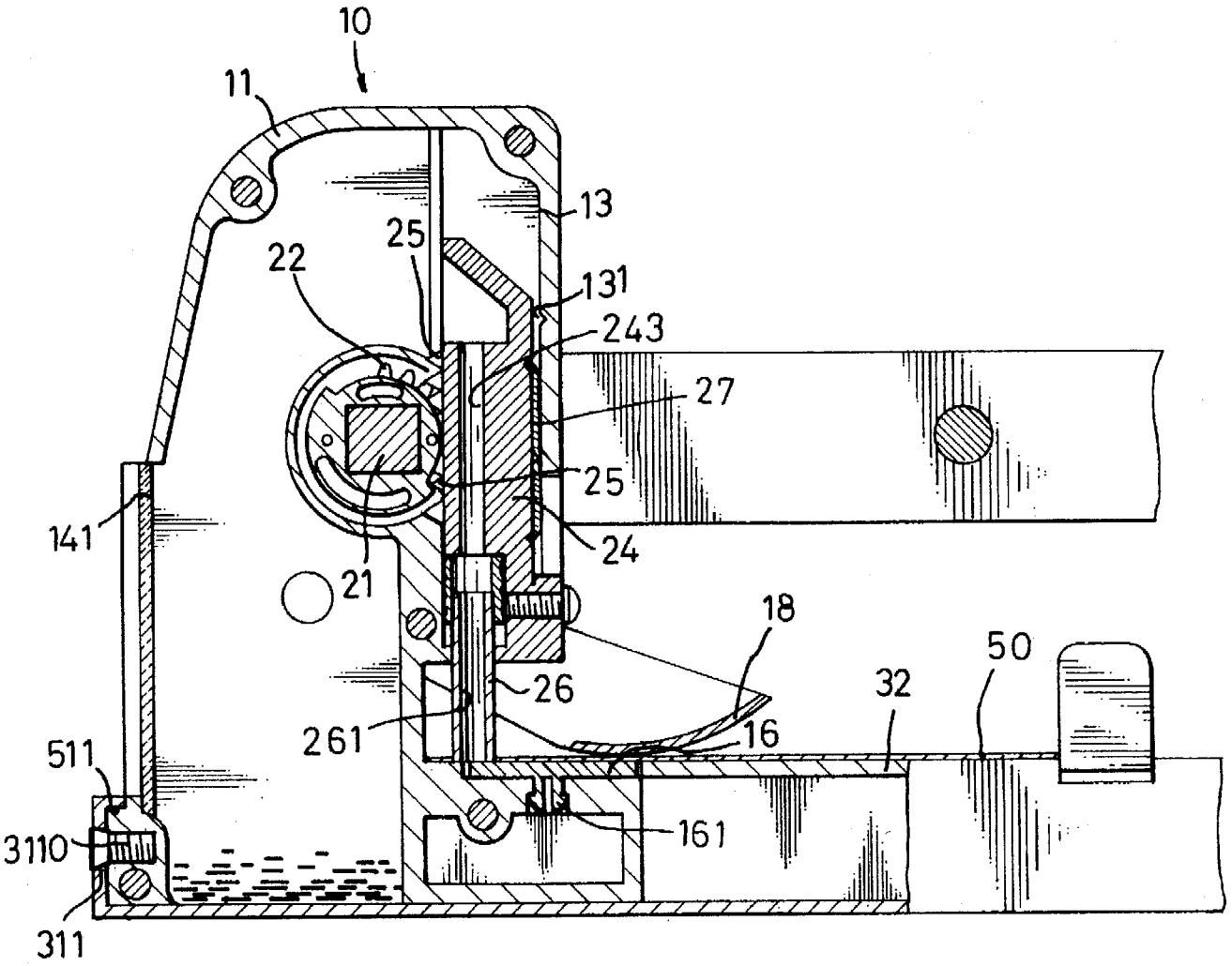
FIG. 4 is a side elevational view, partly in section, of the punch in accordance with the present invention wherein the punching rod is pushed downwardly.

Referring now to FIG. 4, when a user pushes downwardly on the handle 40, the toothed elements 22, engaged with the racks 25, pivot and move the block 24 downwardly to penetrate papers 50 pressed by the pressing element 18 of the punching rod 26. In this action, the elongated plate 27 is moved with the block 24 and the protrusion 272 of the elongated plate 27 moves out of the notch 131 of the box portion 13. When the handle 40 is pivoted upwardly, the block 24 is moved upwardly until the protrusion 272 is again received within the notch 131.

The punching rod 26 has a central longitudinal passage 261 which communicates with the passage 243 of the block 24 such that paper pieces being cut from the paper 50 by the punching rod 26 can accumulate in the central passage 261 and the passage 243.

The uppermost cut pieces in the passage 243 are pushed upwardly to open portion 137 and drop in an area between the transparent board 141 and the base portion 30 when another punching action is taken. An extending portion 32 may be slidably mounted to the base portion 30 to support longer sized papers 50.

Figure 5:
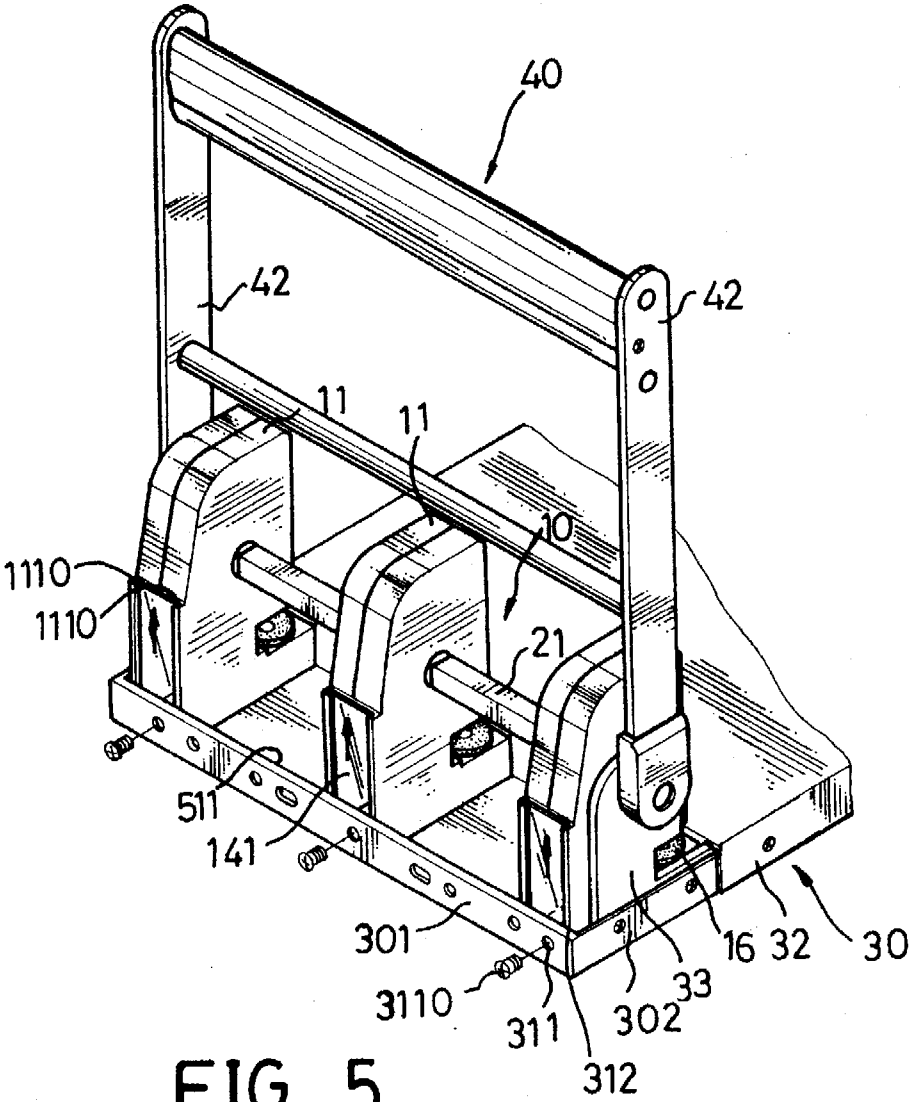
FIG. 5 is a perspective view of the punch and shows a view from the rear side of the punch.
Figure 6:
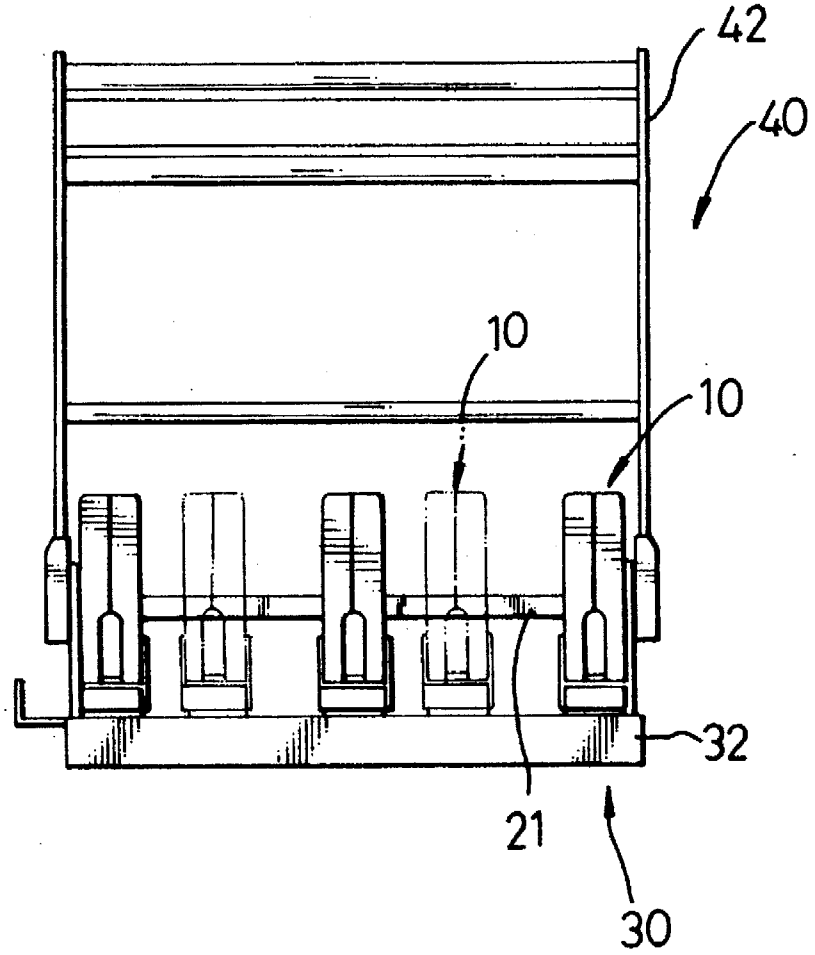
FIG. 6 is a front elevational view of the punch wherein the punching units are moved and are shown by phantom lines.

Referring to FIGS. 5 and 6, when adjusting the distance between two punching rods 26, the bolts 3110 are disengaged from the casing 11 and the first wall 301. The casing 11 can be moved along the shaft 21 to a location corresponding to another first hole 311. The casing 11 is then fixed in position by threadedly re-engaging the bolt 3110 to the casing 11 via the hole 311.

Accordingly, the present invention provides a feature of adjusting a distance between two punching rods 26. Furthermore, the punching rod 26 moved by the engagement between the toothed elements 22 and the racks 25 is stable and powerful, especially when cooperated with a known hydraulic system for pushing the handle 40.

Although the invention has been explained in relation to its preferred embodiment, it is to be understood that many other possible modifications and variations can be made without departing from the spirit and scope of the invention.

What is claimed is:

1. A punch comprising:

a base portion having a first end and a second end, said first end having a first wall extending upwardly and having at least two holes defined in said first wall;

at least two punching units disposed at said first end of said base portion, each one of said punching units further comprising:

a casing having a first end and a second end, said first end of said casing attached to said first wall of said base portion by bolts extending through said holes in said first wall, said first end of said casing having an opening, said second end of said casing having a box portion, a support portion, said box portion having an inner space defined by a closed top, an open bottom, an inner partition, and an inner side, said inner partition having a first opening for communication between said inner space of said box portion and said first end of said casing, said support portion disposed below and spaced apart from said open bottom of said box portion;

a block disposed in said space, said block having a longitudinal passage for receiving and retaining a punching rod, said punching rod extending from said open bottom;

at least one rack disposed in said block;

an actuating means disposed in said casing and having at least one toothed element engageable with said rack through a second opening in said partition;

a first lug extending upwardly from a first side of said base portion and a second lug extending upwardly from a second side of said base portion;

a shaft extending through each of said casings, each of said lugs, and said actuating means, said actuating means securely mounted to and rotatable by said shaft; and a handle attached to said shaft for rotating said shaft to move said punching rod from a first position to a second position.

2. The punch as claimed in claim 1 wherein said base portion has a first flange along a top edge of said first wall and extending toward said second end of said base portion and said first end of said casing has a shoulder portion engaging an underside of said first flange.

3. The punch as claimed in claim 1 wherein each one of said punching units further comprises a pivotal pressing element, said pressing element having a U-shaped element and two distal ends, pivotally mounted to said casing.

4. The punch as claimed in claim 1 wherein said support portion has a hole in an upper surface and a receiving piece attached to said support portion by a protrusion extending from an underside of said receiving piece, and fitted into said hole of said support portion.

* * * * *